US009385466B2

(12) United States Patent
Henry et al.

(10) Patent No.: US 9,385,466 B2
(45) Date of Patent: Jul. 5, 2016

(54) RETENTION FEATURES FOR CABLE ASSEMBLY OF A PLUGGABLE CONNECTOR

(71) Applicant: Tyco Electronics Corporation, Berwyn, PA (US)

(72) Inventors: Randall Robert Henry, Harrisburg, PA (US); Thomas De Boer, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/526,771

(22) Filed: Oct. 29, 2014

(65) Prior Publication Data

US 2016/0126660 A1 May 5, 2016

(51) Int. Cl.

| | |
|---|---|
| ***H01R 13/58*** | (2006.01) |
| ***H01R 13/506*** | (2006.01) |
| ***H01R 24/60*** | (2011.01) |

(52) U.S. Cl.

CPC ..... *H01R 13/506* (2013.01); *H01R 13/5845* (2013.01); *H01R 24/60* (2013.01)

(58) Field of Classification Search

CPC ..... H01R 13/514; H01R 13/516
USPC ..... 439/606, 345, 589, 901, 903
See application file for complete search history.

(56) References Cited

U.S. PATENT DOCUMENTS

| | | | | |
|---|---|---|---|---|
| 5,217,386 A * | 6/1993 | Ohsumi | ..... | H01R 13/6215 439/248 |
| 8,770,990 B2 * | 7/2014 | Sytsma | ..... | H01R 9/034 439/76.1 |

* cited by examiner

*Primary Examiner* — Vanessa Girardi

(57) ABSTRACT

A pluggable connector includes a plug body having a cavity and at least one latch and a cable assembly having electrical contacts and at least one cable terminated to corresponding electrical contacts. The cable assembly has a cable support body engaging and surrounding each electrical contact and each cable. The positions of the electrical contacts and cable are fixed relative to the cable support body. A retention clip is separately provided from and removably coupled to the cable support body. The retention clip has at least one retention tab extending therefrom being received in the cavity such that the retention tab engages the corresponding latch of the plug body to retain the cable assembly in the cavity.

18 Claims, 5 Drawing Sheets

RETENTION FEATURES FOR CABLE ASSEMBLY OF A PLUGGABLE CONNECTOR

BACKGROUND

The subject matter herein relates generally to retention features for a cable assembly of a pluggable connector.

Cable assemblies may be used to transfer data to and from different communication systems or devices. Known cable assemblies include serial attached (SA) small computer system interface (SCSI) cable assemblies, which may also be referred to as SAS cable assemblies. Such cable assemblies may include a pluggable connector having a mating or plug end and a cable end. The mating end is inserted into a receptacle assembly of the communication system, and the cable end receives a cable of the cable assembly. In some cases, the pluggable connector includes a circuit board that has electrical contacts, such as contact pads, that are exposed at the mating end. The circuit board may be mechanically and electrically coupled to conductors or wires of the cable. Portions of the cables, wires and circuit board may be encased in a cable support body, which may be insert molded over the cables, wires and circuit board after the wires are terminated to the electrical contacts of the circuit board.

Conventional pluggable connectors are not without disadvantages. For instance, the cable support body is used to retain the circuit board and cables in the plug body of the pluggable connector. The material used for manufacturing the cable support body is typically a low temperature, high viscosity overmold material. Such material is well suited for low pressure molding, which is desirable when overmolding the wires and the solder joints to the electrical contacts so that the joints are not damaged. Also, such low pressure molding of the material is desirable to reduce migration of the material into unwanted areas of the pluggable connector. However, such material typically has poor mechanical properties and retention features of the cable support body tend to shear off when cable strain or cable pull is too high. When the retention features fail, the cable and circuit board may be pulled out of the plug body, leading to connector failure. After failure, the entire cable subassembly must be discarded. Accordingly, there is a need for a pluggable connector having a reliable mechanical retention feature.

BRIEF DESCRIPTION

In an embodiment, a pluggable connector is provided that includes a plug body having a plug end and a cable end. The plug end configured to be mated with a communication component. The plug body has a cavity at the cable end and at least one latch accessible to the cavity. A cable assembly has a contact array of electrical contacts configured to engage corresponding contacts of the communication component. The cable assembly has at least one cable terminated to corresponding electrical contacts. The cable assembly has a cable support body engaging and surrounding at least a portion of each electrical contact and engaging and surrounding at least a portion of each at least one cable. The position of the electrical contacts being fixed relative to the cable support body and the position of the at least one cable being fixed relative to the cable support body. The cable assembly is loaded into the cavity such that the at least one cable extends from the cable end of the plug body. A retention clip is separately provided from and removably coupled to the cable support body. The retention clip has at least one retention tab extending therefrom being received in the cavity such that the at least one retention tab engages the corresponding at least one latch of the plug body to retain the cable assembly in the cavity.

In another embodiment, a pluggable connector is provided including a plug body having a plug end and a cable end. The plug end is configured to be mated with a communication component. The plug body has a cavity at the cable end and at least one latch accessible to the cavity. The pluggable connector includes a cable assembly having a circuit board including a contact array of electrical contacts thereon. The cable assembly has at least one cable terminated to corresponding electrical contacts on the circuit board. The cable assembly has a cable support body molded in-situ over at least a portion of the circuit board and at least a portion of each at least one cable after the at least one cable is terminated to the electrical contacts. The position of the circuit board is fixed relative to the cable support body and the position of the at least one cable is fixed relative to the cable support body. The cable assembly is loaded into the cavity such that the at least one cable extends from the cable end of the plug body. A retention clip is separately provided from and removably coupled to the cable support body. The retention clip has at least one retention tab extending therefrom. The retention clip is received in the cavity such that the at least one retention tab engages the corresponding at least one latch of the plug body to retain the cable assembly in the cavity.

In a further embodiment, a pluggable connector is provided including a plug body having a plug end and a cable end. The plug end is configured to be mated with a communication component. The plug body has a cavity at the cable end. The plug body has at least one latch accessible to the cavity. The pluggable connector includes cable assembly having a contact array of electrical contacts configured to engage corresponding contacts of the communication component. The cable assembly has at least one cable terminated to corresponding electrical contacts. The cable assembly has a cable support body manufactured from a first dielectric material. The cable support body engages and surrounds at least a portion of each electrical contact and engages and surrounds at least a portion of each at least one cable. The position of the electrical contacts is fixed relative to the cable support body. The position of the at least one cable is fixed relative to the cable support body. The cable assembly is loaded into the cavity such that the at least one cable extends from the cable end of the plug body. A retention clip is separately provided from and removably coupled to the cable support body. The retention clip is manufactured from a second dielectric material different from the first dielectric material having a higher shear strength than the first dielectric material. The retention clip has at least one retention tab extending therefrom. The retention clip is received in the cavity such that the at least one retention tab engages the corresponding at least one latch of the plug body to retain the cable assembly in the cavity.

DETAILED DESCRIPTION

Figure 1:
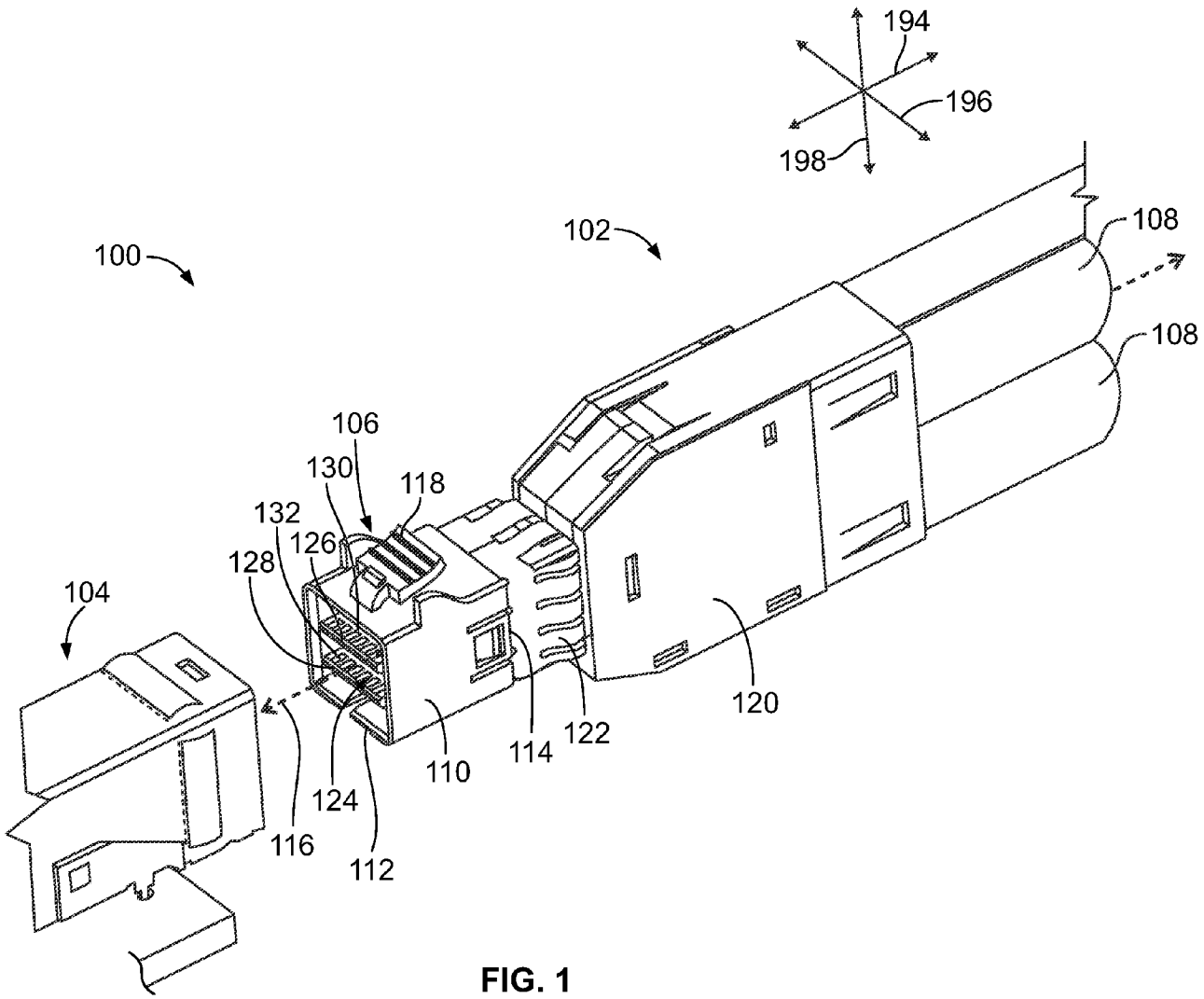
FIG. 1 is a perspective view of a communication system including a plug assembly formed in accordance with an embodiment.

FIG. 1 is a perspective view of a communication system 100 formed in accordance with an embodiment that includes a plug assembly 102 and a communication component or device 104 that are configured to engage each other. The communication component 104 may be a transceiver or a receptacle configured to receive the plug assembly 102. The communication component 104 may be hereinafter referred to as the receptacle assembly 104, but it is understood that the plug assembly 102 may engage or mate with other communication components. Optionally, the receptacle assembly 104 may be board-mounted to a printed circuit board. Alternatively, the receptacle assembly 104 may be mounted to an end of a cable or cables.

The plug assembly 102 includes a pluggable connector 106 at a plug end of the plug assembly 102 with a pair of communication cables 108 attached to the pluggable connector 106. Other embodiments may include only one communication cable 108 or more than one communication cable 108. Although not shown, the plug assembly 102 may include another pluggable connector 106 at an opposite end of the communication cables 108. The pluggable connector 106 has a plug body 110 that includes a plug end 112 and a cable end 114. The plug and cable ends 112, 114 may face in opposite directions along a central longitudinal axis 116 of the pluggable connector 106. The communication cables 108 extend from the cable end 114 of the plug body 110. In certain embodiments, the pluggable connector 106 may include a coupling mechanism 118, such as a plug latch, extending from the plug body 110 for securing the pluggable connector 106 to the receptacle assembly 104. In an exemplary embodiment, a backshell 120 of the plug assembly 102 may be provided rear of the pluggable connector 106. The backshell 120 may provide electrical shielding for the cables 108. The backshell 120 may have spring fingers 122 that are used to electrically connect the backshell 120 to the receptacle assembly 104. For example, the spring fingers 122 may be at least partially received in the receptacle assembly 104 with the pluggable connector 106 and engage a grounded or conductive portion of the receptacle assembly 104.

For reference, the communication system 100 is oriented with respect to mutually perpendicular axes 194-198, including a mating axis 194, a lateral axis 196, and an elevation axis 198. In FIG. 1, the pluggable connector 106 is oriented such that the longitudinal axis 116 is parallel to the mating axis 194.

The plug end 112 of the plug body 110 is configured to be inserted into a cavity of the receptacle assembly 104. To insert the plug end 112 into the receptacle assembly 104, the pluggable connector 106 is aligned with respect to the cavity of the receptacle assembly 104 and advanced toward the receptacle assembly 104 in a mating direction. The plug end 112 is inserted into the receptacle assembly 104 and advanced toward a mating connector (not shown) disposed within the cavity. The pluggable connector 106 and the receptacle assembly 104 may form a pluggable engagement. The coupling mechanism 118 may removably couple the pluggable connector 106 to the receptacle assembly 104 and prevent the pluggable connector 106 and the receptacle assembly 104 from being inadvertently disengaged such that data transmission is interrupted.

The pluggable connector 106 may be characterized as an input/output (I/O) module that is capable of being repeatedly inserted into and removed from the cavity of the receptacle assembly 104. The communication system 100, the plug assembly 102, and/or the receptacle assembly 104 may be configured for various applications. Non-limiting examples of such applications include host bus adapters (HBAs), redundant arrays of inexpensive disks (RAIDs), workstations, rack-mount servers, servers, storage racks, high performance computers, or switches. The communication system 100 may be, or may be part of, an external serially attached (SA) small computer system interface (SCSI). In such embodiments, the plug assembly 102 may be referred to as a serially attached SCSI (SAS) cable assembly. The plug assembly 102 may be configured for one or more industry standards, such as SAS 2.1 in which the plug assembly 102 may be capable of transmitting six (6) gigabits per second (Gbps) for each lane. In more particular embodiments, the plug assembly 102 may be configured for SAS 3.0 and/or at 12 Gbps or more per lane. The pluggable connector 106 may be configured to be compliant with small form factor (SFF) industry standards, such as SFF-8644 or SFF-8449 HD. In some embodiments, the plug assembly 102 may be similar to the cable assembly used with the Mini SAS HD Interconnect, which is available from TE Connectivity.

The plug body 110 forms a cavity 124 that opens to the plug end 112 and/or the cable end 114. The longitudinal axis 194 may extend through an approximate center of the cavity 124. In the illustrated embodiment, the pluggable connector 106 includes two circuit boards 126, 128 having electrical contacts 130, 132, respectively, which may be arranged in arrays on the circuit boards 126, 128. The cables 108, such as discrete conductors or wires of the cables 108, are configured to be terminated to corresponding electrical contacts 130, 132. Optionally, the electrical contacts 130, 132 may be provided on both sides of the circuit boards 126, 128. The circuit boards 126, 128 are disposed within the cavity 124. The electrical contacts 130, 132 are configured to engage corresponding electrical contacts (not shown) of the communication connector in the receptacle assembly 104. In some embodiments, the electrical contacts 130, 132 include contact pads at a respective mating end of the circuit boards 126, 128. In alternative embodiments, however, the electrical contacts 130, 132 may include other types of electrical contacts, such as contact beams.

Figure 2:
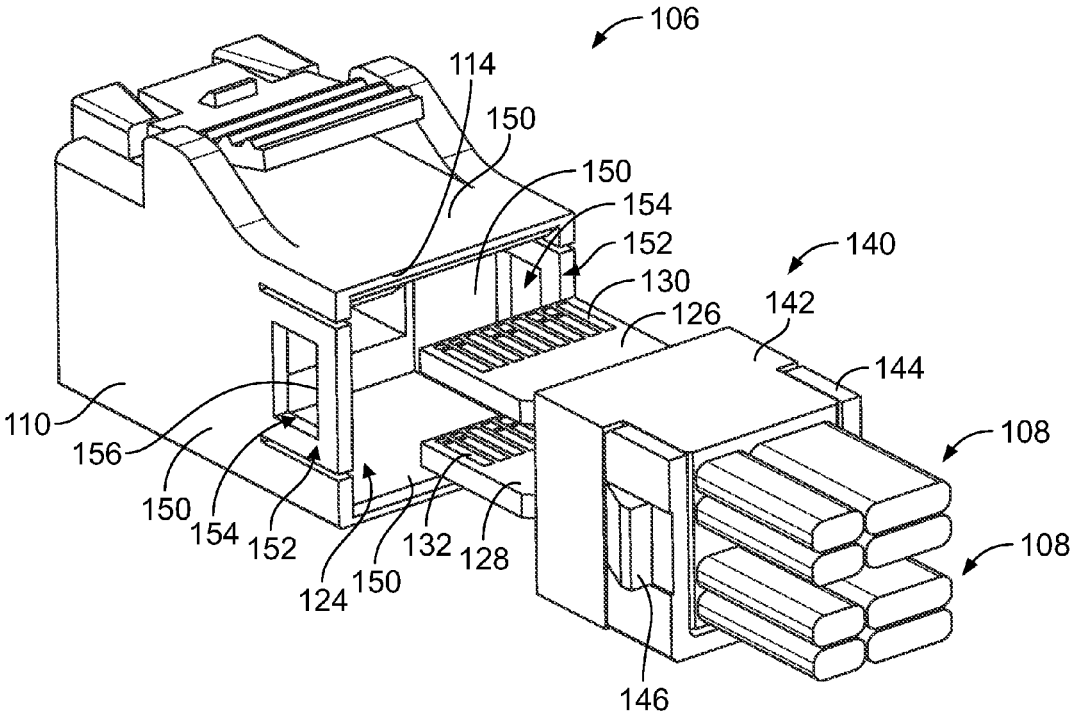
FIG. 2 is a rear perspective, partially exploded view of a pluggable connector of the plug assembly shown in FIG. 1.

FIG. 2 is a rear perspective, partially exploded view of the pluggable connector 106. FIG. 2 shows the cavity 124 of the plug body 110 at the cable end 114. FIG. 2 also shows a cable assembly 140 of the pluggable connector 106 poised for loading into the cavity 124. The cable assembly 140 includes the circuit boards 126, 128 with the electrical contacts 130, 132, as well as a cable support body 142 that supports the cables 108 and circuit boards 126, 128. A retention clip 144 is coupled to the cable support body 142 and is used to hold the cable assembly 140 in the cavity 124 of the plug body 110. For example, the retention clip 144 includes retention tabs 146 extending therefrom that engage the plug body 110 to retain the cable assembly 140 in the cavity 124.

The plug body 110 is sized and shaped for loading into the receptacle assembly 104 (shown in FIG. 1). In an exemplary embodiment, the plug body 110 is manufactured from a dielectric material, such as a polycarbonate material. The plug body 110 may be manufactured from different materials in alternative embodiments, such as another type of plastic material, a metal material, and the like. In the illustrated embodiment, the plug body 110 has a generally rectangular cross section including a plurality of sides 150, such as a top side, a bottom side, a right side, and a left side. The plug body 110 may have other shapes in alternative embodiments.

In an exemplary embodiment, the plug body 110 includes a plurality of latches 152 at or near the cable end 114 that are used to secure the cable assembly 140 in the plug body 110. Optionally, the latches 152 may be deflectable, such as to allow de-latching by a tool for removing the cable assembly 140. In the illustrated embodiment, each latch 152 includes a pocket 154 that is open to the cavity 124. The pocket 154 may extend entirely through the plug body 110 to define a window through the plug body 110. Each latch 152 includes a latching wall 156 at the rear of the corresponding pocket 154. During assembly, the retention tabs 146 are received in the pockets 154 and engage the latching walls 156 to secure the cable assembly 140 in the cavity 124.

Figure 3:
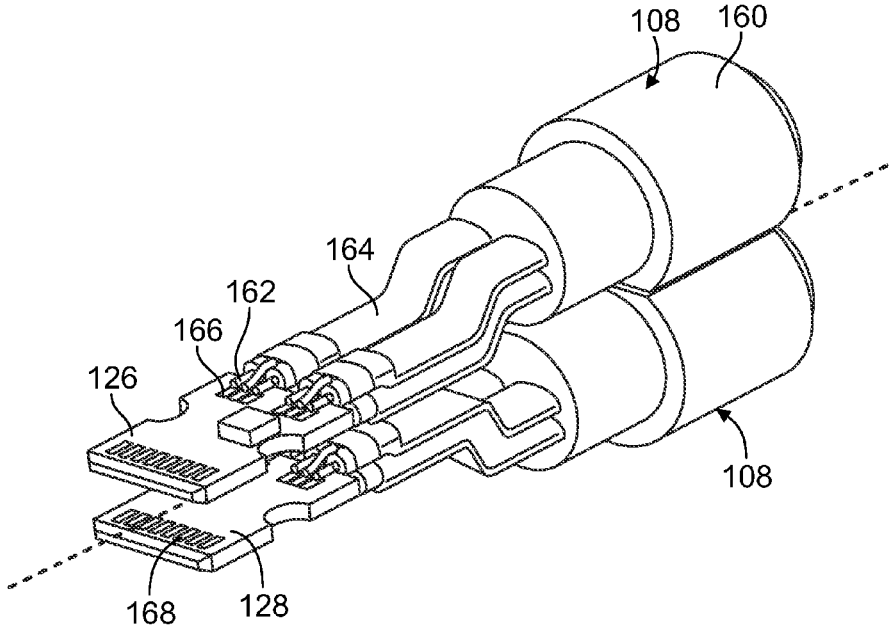
FIG. 3 illustrates a portion of a cable assembly of the pluggable connector shown in FIG. 2.

FIG. 3 illustrates a portion of the cable assembly 140 showing the cables 108 terminated to the circuit boards 126, 128. The cable support body 142 and retention clip 144 (both shown in FIG. 2) are removed to illustrate the termination of the cables 108 to the circuit boards 126, 128. In an exemplary embodiment, each cable 108 includes an outer cable jacket 160 with a plurality of individual, discrete wires 162 inside the outer cable jacket 160. Optionally, the wires 162 may be arranged in groups surrounded by inner cable jackets 164. For example, in the illustrated embodiment, each group of wires 162 include a pair of signal wires, defining differential signal pairs, and a ground or drain wire all contained within a corresponding inner cable jacket 164. In the illustrated embodiment, each cable 108 includes multiple wire groups. Optionally, each wire group may be individually shielded by a cable braid. Other arrangements of the wires 162 are possible in alternative embodiments.

In an exemplary embodiment, multiple wire groups are terminated to each circuit board 126, 128. Optionally, the wires 162 may be terminated to both the top and bottom sides of the corresponding circuit boards 126, 128. The wires 162 may be terminated in accordance with known termination techniques, such as soldering the wires 162 to corresponding solder pads 166 at the rear end of the corresponding circuit board 126, 128. The electrical contacts 130, 132 include the solder pads 166 and metal traces on the circuit boards 126, 128 that extend to mating contact pads 168 at front ends of the circuit boards 126, 128. Due to the fragile termination between the wires 162 and the solder pads 166, the cable support body 142 (shown in FIG. 2) is used to provide strain relief for the wires 162 and cables 108.

Figure 4:
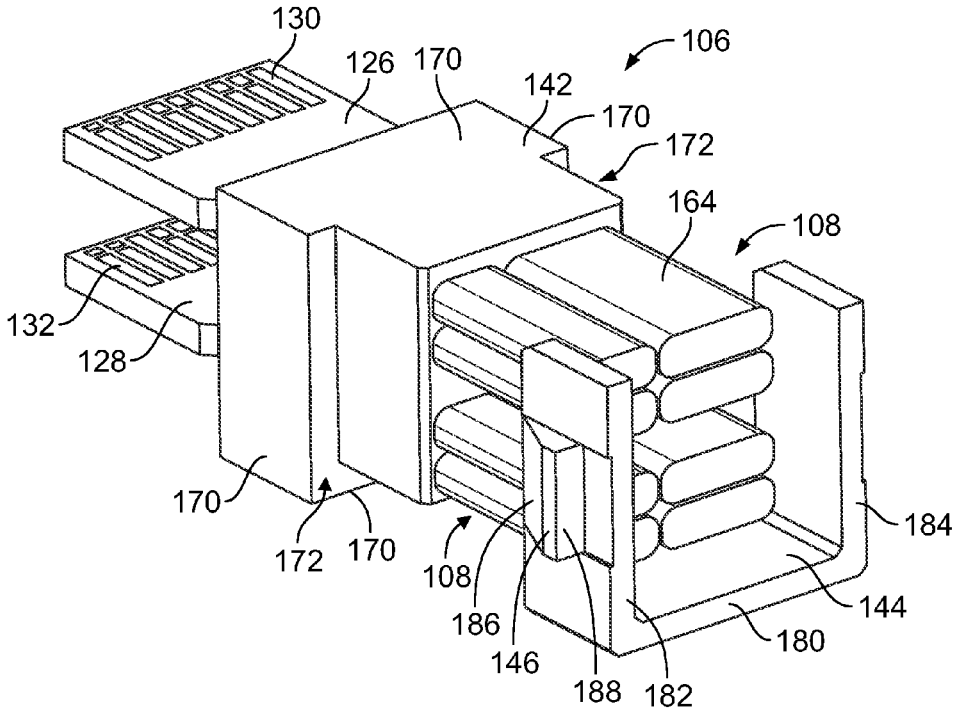
FIG. 4 is a rear perspective view of a portion of the pluggable connector shown in FIG. 2.
Figure 5:
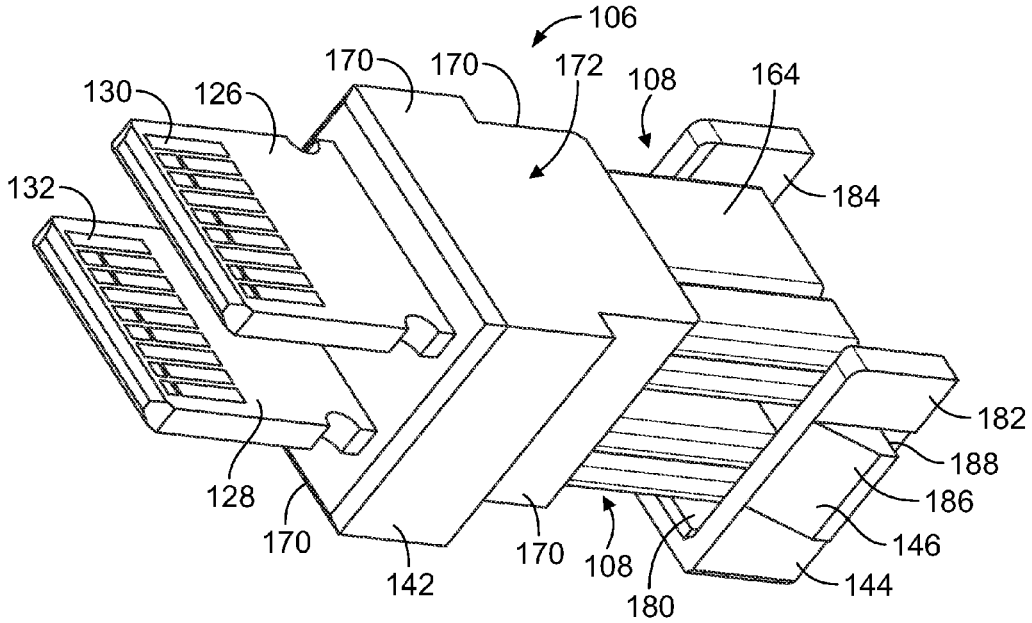
FIG. 5 is a front perspective view of a portion of the pluggable connector shown in FIG. 2.

FIG. 4 is a rear perspective view of a portion of the pluggable connector 106 showing the cable support body 142 surrounding the cables 108 and circuit boards 126, 128. FIG. 5 is a front perspective view of a portion of the pluggable connector 106 showing the cable support body 142 surrounding the cables 108 and circuit boards 126, 128. The retention clip 144 is illustrated in FIGS. 4 and 5 poised for loading onto the cable support body 142. The cable support body 142 encases the cables 108, wires 162 (FIG. 3) and circuit boards 126, 128 to provide strain relief such as for the cables 108 and for the terminations of the wires 162 to the circuit boards 126, 128.

In an exemplary embodiment, the cable support body 142 is an overmold structure molded in-situ over the cables 108, wires 162 and circuit boards 126, 128. The overmold structure attaches to the cables 108, wires 162 and/or circuit boards 126, 128 to provide strain relief for the cables 108 and the termination of the wires 162 to the circuit boards 126, 128. The cable support body 142 may be manufactured using a low pressure insert mold from a material having a high viscosity. Using a low pressure insert mold reduces blow-through, flashing and/or overflow around the circuit boards 126, 128. Using the low pressure insert mold reduces air gaps and reduces the risk of damage to the solder joints, both of which are problems with high pressure insert molds. The overmold material completely fills the insert mold such that the material engages and surrounds at least a portion of the circuit boards 126, 128, including portions of the electrical contacts 130, 132. The overmold material engages and surrounds the solder joints, including portions of the wires 162. The overmold material engages and surrounds at least portion of the cables 108, such as the inner cable jackets 164 and/or the outer cable jackets 160. The overmold material completely encases and surrounds portions of the wires 162 and is provided between adjacent wires 162. The overmold material complete encases and surrounds portions of the inner cable jackets 164 and is provided between adjacent inner cable jackets 164. Having the overmold material in such locations provides a solid attachment to the cables 108, the wires 162 and the circuit boards 126, 128. As such, the positions of the electrical contacts 130, 132 are fixed relative to the cable support body 142. The positions of the solder joints and wires 162 are fixed relative the cable support body 142. The positions of the cables 108 are fixed relative to the cable support body 142. The positions of the circuit boards 126, 128 are fixed relative to the cable support body 142. Having the circuit boards 126, 128 fixed relative to, and extending forward of, the cable support body 142 allows the circuit boards 126, 128 to be loaded into proper position within the plug body 110 (shown in FIG. 2).

The cable support body 142 is sized and shaped to fit within the cavity 124 (shown in FIG. 2) of the plug body 110. In the illustrated embodiment, the cable support body 142 has a plurality of sides 170, such as a top side, a bottom side, a right side, and a left side. Optionally, the cable support body 142 may have a generally rectangular cross-section. The cable support body may have a T-shape being wider at the front and narrower at the rear; however, other shapes are possible in alternative embodiments. In an exemplary embodiment, the cable support body 142 includes a notch-out 172 that receives the retention clip 144. The notch-out 172 may be provided near a rear of the cable support body 142. The notch-out 172 may be provided on multiple sides 170. In the illustrated embodiment, the notch-out 172 is provided along the right and left sides as well as the bottom side. The notch-out 172 is provided such that when the retention clip 144 is coupled to the cable support body 142 the retention clip 144 is flush with an exterior of the cable support body 142.

The retention clip 144 is configured to be coupled to the cable support body 142. In an exemplary embodiment, the retention clip 144 is sized and shaped to fit within the notch-out 172 of the cable support body 142. The retention clip 144 may be secured to the cable support body 142 by an interference fit. In the illustrated embodiment, the retention clip 144 is U-shaped and includes a base 180 and opposite first and second arms 182, 184 extending upward from opposite ends of the base 180. The retention tabs 146 extend outward from the arms 182, 184. The retention tabs 146 include forward ramp surfaces 186 and a rear stop surface 188. The ramp surfaces 186 are used for loading the retention clip 144 into the plug body 110. The stop surfaces 188 are used to retain the retention clip 144 in the plug body 110.

Figure 6:
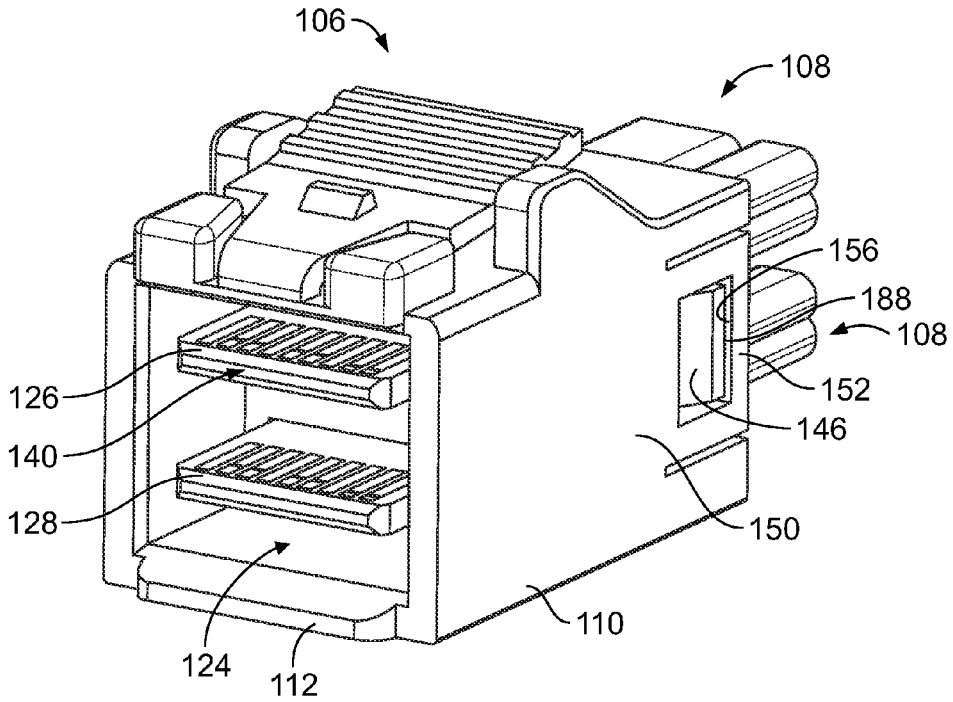
FIG. 6 is a front perspective view of the pluggable connector shown in FIG. 2.
Figure 7:
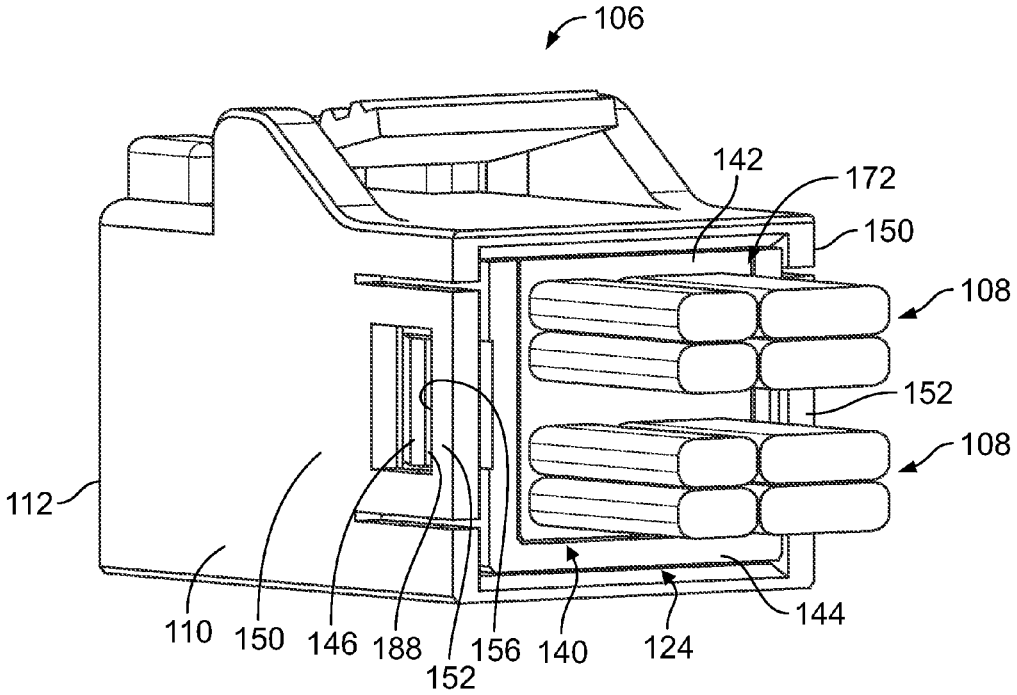
FIG. 7 is a rear perspective view of the pluggable connector shown in FIG. 2.
Figure 8:
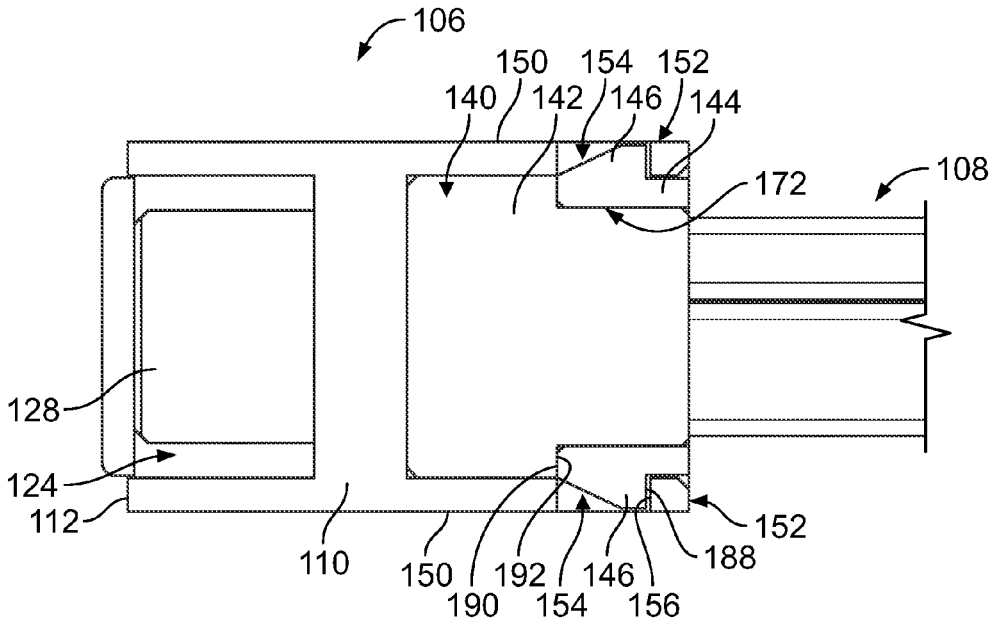
FIG. 8 is a cross sectional view of the pluggable connector shown in FIG. 2.
Figure 9:
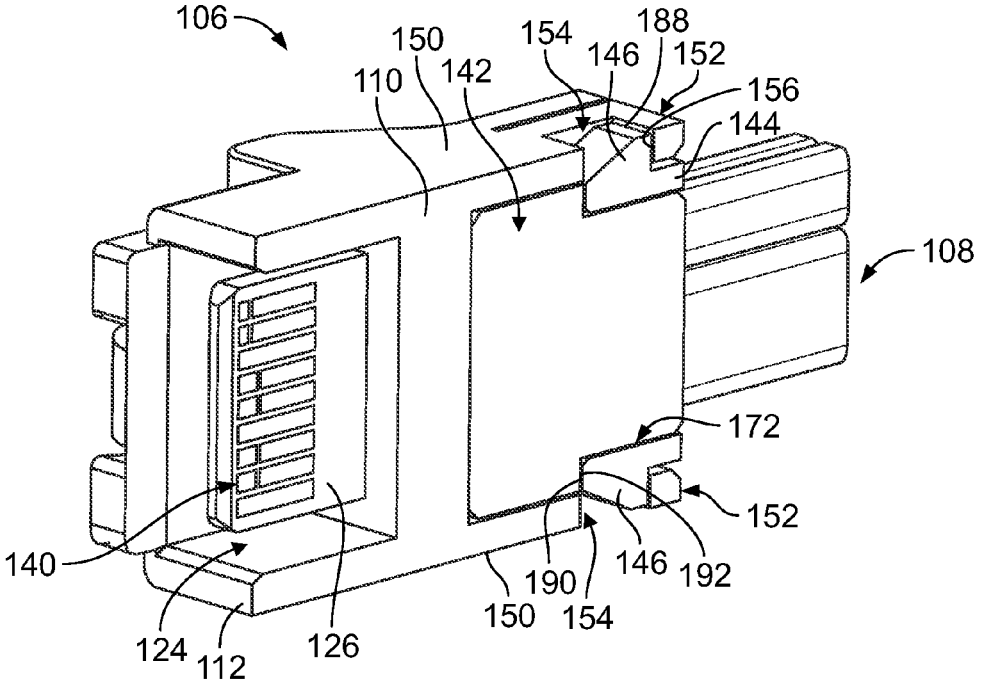
FIG. 9 is a cross sectional view of the pluggable connector shown in FIG. 2.

FIG. 6 is a front perspective view of the pluggable connector 106. FIG. 7 is a rear perspective view of the pluggable connector 106. FIGS. 8 and 9 are cross sectional views of the pluggable connector 106. FIG. 6-9 illustrate the pluggable connector 106 in an assembled state with the cable assembly 140 loaded into the cavity 124 of the plug body 110. The circuit boards 126, 128 are held in the cavity 124 near the plug end 112 for mating with the receptacle assembly 104 (shown in FIG. 1).

The retention clip 144 is shown coupled to the cable support body 142 and is used to retain the cable support body 142 in the cavity 124. For example, during assembly, the retention tabs 146 engage the corresponding latches 152 in the first and second sides 150 of the cavity 124. For example, the retention tabs 146 are received in the pockets 154 and the latching walls 156 block the stop surfaces 188 to prevent removal of the cable assembly 140 from the cavity 124. The stop surfaces 188 may engage or abut the latching walls 156.

As shown in FIGS. 8 and 9, a front edge 190 of the retention clip 144 engages a rear shoulder 192 of the cable support body 142. The rear shoulder 192 is provided at a forward end of the notch-out 172. Rearward movement or pullout of the cable support body 142 is blocked by the front edge 190 of the retention clip 144. As such, the retention clip 144 retains the cable support body 142 in the plug body 110.

In an exemplary embodiment, the cable support body 142 is manufactured from a first dielectric material and the retention clip 144 is manufactured from a second dielectric material different than the first dielectric material. The dielectric material of the retention clip has a greater shear strength than the dielectric material of the cable support body 142. The material of the retention clip 144 is stronger than the material of the cable support body 142. As such, the retention clip 144 is able to withstand greater pullout forces on the cable 108 for greater retention of the cable assembly 140 in the plug body 110, as compared to cable assemblies having retention tabs 146 manufactured from the same material as the cable support body 142. The dielectric material of the retention clip 144 may be harder than the dielectric material of the cable support body 142. The material of the retention clip 144 may have better mechanical properties than the material of the cable support body 142. However, if the shear strength of the retention tabs 146 is overcome such that the retention tabs 146 are sheared off from the retention clip 144, thus allowing the cable assembly 140 to be pulled out of the plug body 110, the broken or damaged retention clip 144 may simply be removed from the cable support body 142 and replaced with a new retention clip 144. The cable assembly 140 is then able to be reloaded into the plug body 110. The same cable support body 142, circuit boards 126, 128 and wires 162 may be reused in such situations. The cable assembly 140 does not need to be discarded when the retention tabs 146 break or shear off. Rather, a replacement retention clip 144 may be used to again secure the cable assembly 140 in the plug body 110.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A pluggable connector comprising:

a plug body having a plug end and a cable end, the plug end configured to be mated with a communication component, the plug body having a cavity at the cable end, the plug body having at least one latch accessible to the cavity;

a cable assembly having a contact array of electrical contacts configured to engage corresponding contacts of the communication component, the cable assembly having at least one cable terminated to corresponding electrical contacts, the cable assembly having a cable support body manufactured from a first dielectric material, the cable support body engaging and surrounding at least a portion of each electrical contact and engaging and surrounding at least a portion of each at least one cable, the positions of the electrical contacts being fixed relative to the cable support body, the position of the at least one cable being fixed relative to the cable support body, the cable assembly being loaded into the cavity such that the at least one cable extends from the cable end of the plug body; and a retention clip separately provided from and removably coupled to the cable support body, the retention clip being manufactured from a second dielectric material different from the first dielectric material having a higher shear strength than the first dielectric material, the retention clip having at least one retention tab extending therefrom, the retention clip being received in the cavity such that the at least one retention tab engages the corresponding at least one latch of the plug body to retain the cable assembly in the cavity.

2. A pluggable connector comprising:

a plug body having a plug end and a cable end, the plug end configured to be mated with a communication component, the plug body having a cavity at the cable end, the plug body having at least one latch accessible to the cavity;

a cable assembly having a circuit board including a contact array of electrical contacts thereon, the cable assembly having at least one cable terminated to corresponding electrical contacts on the circuit board, the cable assembly having a cable support body molded in-situ over at least a portion of the circuit board and at least a portion of each at least one cable after the at least one cable is terminated to the electrical contacts, the position of the circuit board being fixed relative to the cable support body, the position of the at least one cable being fixed relative to the cable support body, the cable assembly being loaded into the cavity such that the at least one cable extends from the cable end of the plug body; and a retention clip separately provided from and removably coupled to the cable support body, the retention clip having at least one retention tab extending therefrom, the retention clip being received in the cavity such that the at least one retention tab engages the corresponding at least one latch of the plug body to retain the cable assembly in the cavity, wherein the cable support body is manufactured from a first dielectric material and the retention clip is manufactured from a second dielectric material different than the first dielectric material and having a greater shear strength than the first dielectric material.

3. The pluggable connector of claim 2, wherein the cable support body is molded in-situ over the circuit board and each at least one cable.

4. The pluggable connector of claim 2, wherein the electrical contacts comprise solder pads, wires of the at least one cable being soldered to the solder pads, the cable support body encasing the solder pads and the wires at termination locations of the wires to the solder pads.

5. A pluggable connector comprising:

a plug body having a plug end and a cable end, the plug end configured to be mated with a communication component, the plug body having a cavity at the cable end, the plug body having at least one latch accessible to the cavity;

a cable assembly having a contact array of electrical contacts configured to engage corresponding contacts of the communication component, the cable assembly having at least one cable terminated to corresponding electrical contacts, the cable assembly having a cable support body engaging and surrounding at least a portion of each electrical contact and engaging and surrounding at least a portion of each at least one cable, the positions of the electrical contacts being fixed relative to the cable support body, the position of the at least one cable being fixed relative to the cable support body, the cable assembly being loaded into the cavity such that the at least one cable extends from the cable end of the plug body; and a retention clip separately provided from and removably coupled to the cable support body, the retention clip having at least one retention tab extending therefrom, the retention clip being received in the cavity such that the at least one retention tab engages the corresponding at least one latch of the plug body to retain the cable assembly in the cavity, wherein the retention clip is coupled to the cable support body prior to the cable support body and the retention clip being loaded into the cavity.

6. The pluggable connector of claim 5, wherein the cable support body is manufactured from a first dielectric material and the retention clip is manufactured from a second dielectric material different than the first dielectric material and having a greater shear strength than the first dielectric material.

7. The pluggable connector of claim 5, wherein the retention clip is provided at a rear of the cable support body to hold the cable support body in the cavity.

8. The pluggable connector of claim 5, wherein the retention clip blocks the cable support body from removal from the cavity.

9. The pluggable connector of claim 5, wherein the retention clip is U-shaped and extends along three sides of the cable support body.

10. The pluggable connector of claim 5, wherein the at least one latch includes a first latch on a first side of the cavity and a second latch on a second side of the cavity opposite the first side, the at least one retention tab includes first and second retention tabs extending outward from opposite sides of the retention clip for engagement with the first and second latches, respectively.

11. The pluggable connector of claim 5, wherein the at least one latch includes a pocket receiving the corresponding at least one retention tab and a latching wall engaging the corresponding at least one retention tab to retain the at least one retention tab in the pocket.

12. The pluggable connector of claim 5, wherein the cable support body includes a notch-out receiving the retention clip.

13. The pluggable connector of claim 5, wherein the retention clip is secured to the cable support body by an interference fit.

14. The pluggable connector of claim 5, wherein the cable support body is molded in-situ over each at least one cable.

15. The pluggable connector of claim 5, wherein the at least one cable comprises a plurality of cables, the cable support body surrounding each of the cables and located between the cables.

16. The pluggable connector of claim 5, wherein the cable assembly further comprises a first circuit board and a second circuit board comprising corresponding electrical contacts, the cable support body engaging and surrounding at least a portion of both of the first and second circuit boards.

17. The pluggable connector of claim 5, wherein the cable assembly further comprises a circuit board comprising the electrical contacts, the cable support body engaging and surrounding at least a portion of the circuit board.

18. The pluggable connector of claim 17, wherein the electrical contacts comprise solder pads, wires of the at least one cable being soldered to the solder pads, the cable support body encasing the solder pads and the wires at termination locations of the wires to the solder pads.

* * * * *